US010637155B2

(12) United States Patent
Li et al.

(10) Patent No.: US 10,637,155 B2
(45) Date of Patent: Apr. 28, 2020

(54) ANTENNA ASSEMBLY, UNSHIELDED CIRCUIT ASSEMBLY AND RADIATING UNIT ASSEMBLY

(71) Applicant: CommScope Technologies LLC, Hickory, NC (US)

(72) Inventors: Haifeng Li, Suzhou (CN); Yuemin Li, Suzhou (CN); Xia Mei, Suzhou (CN); Jinchun He, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 61 days.

(21) Appl. No.: 15/983,117

(22) Filed: May 18, 2018

(65) Prior Publication Data

US 2018/0342813 A1 Nov. 29, 2018

(30) Foreign Application Priority Data

May 24, 2017 (CN) ..... 2017 1 0376044

(51) Int. Cl.

| | |
|---|---|
| ***H01Q 21/00*** | (2006.01) |
| ***H01Q 13/20*** | (2006.01) |
| ***H01Q 21/08*** | (2006.01) |
| ***H01Q 9/24*** | (2006.01) |
| ***H01Q 1/52*** | (2006.01) |
| ***H01Q 1/48*** | (2006.01) |
| ***H01Q 1/00*** | (2006.01) |
| ***H01Q 3/34*** | (2006.01) |

(Continued)

(52) U.S. Cl.

CPC ..... *H01Q 21/0006* (2013.01); *H01Q 1/002* (2013.01); *H01Q 1/48* (2013.01); *H01Q 1/526* (2013.01); *H01Q 1/528* (2013.01); *H01Q 3/34* (2013.01); *H01Q 9/045* (2013.01); *H01Q 9/285* (2013.01); *H01Q 13/203* (2013.01); *H01Q 21/08* (2013.01); *H01P 1/202* (2013.01); *H01Q 1/246* (2013.01); *H01Q 9/16* (2013.01)

(58) Field of Classification Search

CPC .... H01Q 21/0006; H01Q 21/18; H01Q 21/08; H01Q 13/203; H01Q 9/285; H01Q 1/002; H01Q 21/00; H01Q 13/20; H01Q 1/48; H01Q 1/526; H01Q 9/24; H01Q 9/16; H01Q 1/52

USPC ..... 343/795

See application file for complete search history.

(56) References Cited

U.S. PATENT DOCUMENTS

2004/0046697 A1* 3/2004 Tai ..... H01Q 1/243 343/700 MS

2009/0295642 A1* 12/2009 Nilsson ..... H01Q 11/04 343/700 MS (Continued)

FOREIGN PATENT DOCUMENTS

WO 2010/077574 7/2010

OTHER PUBLICATIONS

Extended European Search Report corresponding to European Application No. 18172600.1 (9 pages) (dated Oct. 9, 2018).

*Primary Examiner* — Hai V Tran

(74) *Attorney, Agent, or Firm* — Myers Bigel, P.A.

(57) ABSTRACT

An antenna assembly comprises a plurality of radiating elements; an unshielded circuit; and an input terminal; wherein the radiating elements are connected to the unshielded circuit through a plurality of cables, and the unshielded circuit is connected to the input terminal through an input cable; and wherein at least one of the plurality of cables and the input cable is connected to an open connect line.

23 Claims, 2 Drawing Sheets

(51) Int. Cl.

| | |
|---|---|
| ***H01Q 9/04*** | (2006.01) |
| ***H01Q 9/28*** | (2006.01) |
| *H01Q 1/24* | (2006.01) |
| *H01P 1/202* | (2006.01) |
| *H01Q 9/16* | (2006.01) |

(56) References Cited

U.S. PATENT DOCUMENTS

| | | | | |
|---|---|---|---|---|
| 2013/0265206 | A1 | 10/2013 | Payne et al. | |
| 2014/0266923 | A1* | 9/2014 | Zhou | H01Q 5/35 343/702 |
| 2016/0043476 | A1 | 2/2016 | Bi et al. | |
| 2017/0093363 | A1* | 3/2017 | Tabatabai | H03H 7/20 |

* cited by examiner

ANTENNA ASSEMBLY, UNSHIELDED CIRCUIT ASSEMBLY AND RADIATING UNIT ASSEMBLY

CLAIM OF PRIORITY

The present application claims priority under 35 U.S.C. § 119 to Chinese Patent Application No. 201710376044.8, filed with the Chinese State Intellectual Property Office on May 24, 2017, the entire contents of which is incorporated by reference herein as if set forth in its entirety.

FIELD

The present disclosure generally relates to antenna systems and, more particularly, to antenna systems having feed networks that include unshielded circuits.

BACKGROUND

Passive InterModulation (PIM) distortion is a form of electrical interference that may occur when two or more radio frequency (RF) signals encounter non-linear electrical junctions or materials along an RF transmission path. Such non-linearities may act like a mixer causing the RF signals to generate new RF signals at mathematical combinations of the original RF signals. These newly generated RF signals are referred to as "intermodulation products." The newly generated RF signals may fall within the bandwidth of existing RF signals. This may occur, for example, when signals transmitted through a device generate intermodulation products that fall in the same bandwidth of signals that are received through the same device. If this occurs, the noise level experienced by the existing RF signals in the receiver bandwidth is increased. When the noise level is increased, it may be necessary to reduce the data rate and/or the quality of service. PIM distortion can be an important interconnection quality characteristic, as PIM distortion generated by a single low quality interconnection may degrade the electrical performance of the entire RF communications system. An unexpected current from an outer conductor of a cable in the antenna may increase PIM distortion levels and/or influence the isolation stability of the antenna.

The unexpected current may occur in an unshielded circuit that is included in a feed network of the antenna. The unshielded circuit may be, for example, any element made of microstrip or printed circuit board materials that is capable of radiating outwards.

For example, the unshielded circuit may be a power divider or a phase shifter. A plurality of cables may be attached to the unshielded circuit. For example, if the unshielded circuit is a phase shifter, an input cable and a plurality of several phase cables may be connected to the unshielded circuit. An unexpected current may appear on an outer conductor of one of these cables.

An unexpected current may also or additionally occur around a radiating element of the antenna. Usually, each radiating element is connected to a reflector of the antenna, which serves as a ground plane, and is also connected to an unshielded circuit via a cable. When performing service and maintenance work, technical personnel may separate the radiating element from the reflector, and thus the radiating element may no longer be connected to ground. In this situation, for example, the unexpected current may leak through the outer conductor of the connecting cable.

SUMMARY

In view of above, the present disclosure proposes an antenna assembly, an unshielded circuit assembly for use in an antenna and a radiating unit assembly used with an antenna to eliminate the abovementioned unexpected current.

According to one aspect of the present disclosure, it is provided an antenna assembly. The antenna assembly includes a plurality of radiating elements; an unshielded circuit; and an input terminal. The plurality of radiating elements are connected to the unshielded circuit through respective ones of a plurality of additional cables, and the unshielded circuit is connected to the input terminal through an input cable; and at least one of the plurality of additional cables and the input cable is connected to a first open connect line.

In one implementation, a second open connect line is connected adjacent to a connection point between a first of the radiating elements and a first of the additional cables that is connected to the first of the radiating elements.

In one implementation, a length of the first open connect line and/or a length of the second open connect line is ¼ a wavelength corresponding to a center frequency of an operating frequency band of the antenna assembly.

In one implementation, at least one of the first open connect line and/or the second open connect line is L-shaped.

In one implementation, the at least one of the plurality of additional cables and the input cable is connected to the first open connect line via welding.

In one implementation, the second open connect line is connected adjacent to the connection point between the first of the radiating elements and the first of the additional cables via welding.

In one implementation, the input cable is connected to the first open connect line.

In one implementation, the at least one of the plurality of additional cables and the input cable is connected to the first open connect line adjacent the unshielded circuit.

In one implementation, the unshielded circuit includes a power divider or a phase shifter.

In one implementation, the radiating element includes a dipole.

According to another aspect of the present disclosure, it is provided an unshielded circuit assembly for use in an antenna. The unshielded circuit assembly includes an unshielded circuit; an input cable; and a plurality of additional cables The input cable and the plurality of additional cables are connected to the unshielded circuit, and at least one of the input cable and the plurality of additional cables is connected to an open connect line.

In one implementation, a length of the open connect line is ¼ of a wavelength corresponding to a center frequency of an operating frequency band of the antenna.

In one implementation, the open connect line is L-shaped.

In one implementation, the at least one of the input cable and the plurality of additional cables is connected to the open connect line via welding.

In one implementation, the input cable is connected to the open connect line.

In one implementation, the at least one of the input cable and the plurality of additional cables is connected to the open connect line adjacent to the unshielded circuit.

In one implementation, the unshielded circuit includes a power divider and a phase shifter.

According to a further aspect of the present disclosure, it is provided a radiating unit assembly used with an antenna. The radiating unit assembly includes a radiating element; and an unshielded circuit. The radiating element is connected to the unshielded circuit through a cable, and an open connect line is connected adjacent a connection point between the radiating element and the phase cable.

In one implementation, a length of the open connect line is ¼ of a wavelength corresponding to a center frequency of an operating frequency band of the antenna.

In one implementation, the open connect line is L-shaped.

In one implementation, the open connect line is connected adjacent the connection point between the radiating element and the cable via welding.

In one implementation, the radiating element includes a dipole.

According to the present disclosure, the unexpected current from the cable outer conductor of the cables in an unshielded circuit and/or in the radiating element area can be fully eliminated. The antenna PIM level and the isolation stability can be enhanced. Also, the common mode resonance can be eliminated.

BRIEF DESCRIPTION OF THE DRAWINGS

The present disclosure will be understood better from the description of specific embodiments of the disclosure given in conjunction with the following figures, wherein.

In the figures, identical or similar reference numerals indicate identical or similar elements.

DETAILED DESCRIPTION

Example embodiments of the present disclosure will now be described in more detail in conjunction with accompanying figures. Although example embodiments are shown in the accompanying figures, it should be understood that the present disclosure can be embodied in various ways and is not limited to the embodiments depicted herein. Instead, the embodiments are provided herein to make the disclosure more thorough and complete and to convey the scope of the present disclosure to those skilled in this art.

Figure 1:
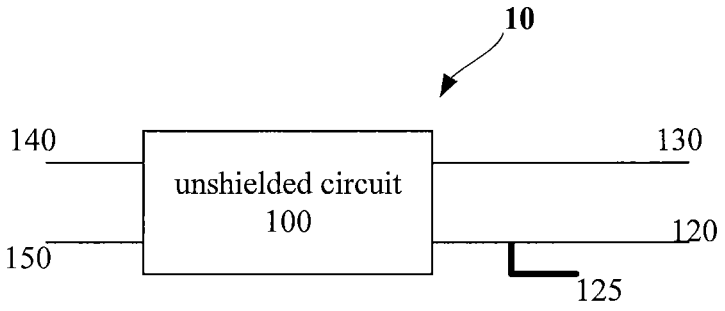
FIG. 1 is a schematic diagram of an assembly according to an embodiment of the present disclosure.

FIG. 1 is a schematic diagram of an assembly 10 according to an embodiment of the present disclosure that includes an unshielded circuit. As shown in FIG. 1, the assembly 10 includes an unshielded circuit 100 and a plurality of cables 120, 130, 140, 150. Any appropriate number of cables may be included. The unshielded circuit 100 may be, for example, an element of an antenna feed network. The unshielded circuit 100 may comprise, for example, a portion of the feed network that is implemented on a printed circuit board (PCB). Because the unshielded circuit 100 does not include shielding, it may radiate energy outwardly. For example, the unshielded circuit 100 can be a power divider or a phase shifter. In an embodiment where the unshielded circuit 100 is a phase shifter, the cable 120 may be an input cable that is on a "radio-side" of the phase shifter and the cables 130, 140 and 150 may be output cables (also commonly referred to as phase cables) that connect (directly or indirectly) to the radiating elements of the antenna.

The input cable 120 may carry RF signals from the radio to the phase shifter 100. The phase shifter 100 may split the input RF signal into a plurality of sub-components (three sub-components in the example of FIG. 1) and may apply different phase shifts to one or more of the sub-components. The sub-components of the RF signal may then be output through the phase cables 130, 140, 150 to, for example, respective radiating elements, or sub-arrays of radiating elements, of an antenna system (not shown). An unexpected current can be incident on the outer conductor of any one of the input cable 120 or the phase cables 130, 140 and 150. This unexpected current may be carried by the cable 120, 130, 140, 150 to the unshielded circuit 100.

Pursuant to embodiments of the present invention, open connect lines may be used to reduce or eliminate an unexpected current that may be carried, for example, on the outer conductor of one of the cables 120, 130, 140, 150. Referring again to FIG. 1, an open connect line 125 can be connected to a cable. In the depicted embodiment, the open connect line 125 is connected to the input cable 120 to eliminate this unexpected current. Herein, an "open connect line" refers to a transmission line that has a distal end that is electrically open.

In another example embodiment, all of the cables can be connected to a respective open connect line 125, so as to reduce or eliminate any unexpected currents that are carried on the outer conductors of cables 120, 130, 140, 150.

In some embodiments, the open connect line 125 may be welded to its associated cable. It will be appreciated, however, that other connection methods may be used or that the open connect line 125 may be formed integrally with the remainder of the cable. In some embodiments, the cable may be connected to the open connect line 125 adjacent the unshielded circuit 100.

Figure 2:
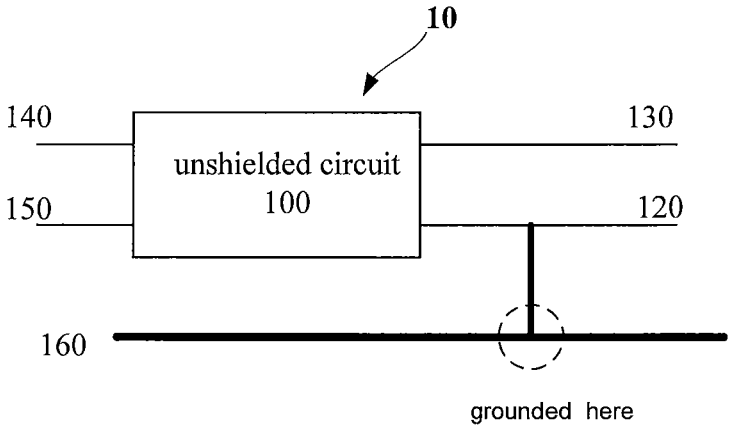
FIG. 2 is an equivalent schematic diagram of the assembly of FIG. 1.

According to an embodiment of the present disclosure, a length of the open connect line 125 may be about ¼ wavelength of a center frequency of a frequency band of the antenna. With respect to signals that are at RF and microwave frequencies, connecting an open connect line 125 with a length of ¼ wavelength to the cable is equivalent to connecting the cable to a grounded element such as, for example, a reflector of the antenna system. FIG. 2 is an equivalent schematic diagram of the assembly of FIG. 1. As shown in FIG. 2, connecting the open connect line 125 to the input cable 120 is equivalent to connecting the input cable 120 to the reflector 160 of an antenna, and thus an unexpected current that appears on the outer conductor of the input cable 120 may be grounded (shown in FIG. 2 with a circle) and thus eliminated.

In one embodiment of the disclosure, the open connect line is L-shaped. However, the present disclosure is not limited thereto and the open connect line 125 can have any appropriate shape such as a straight line shape, etc.

Figure 3:
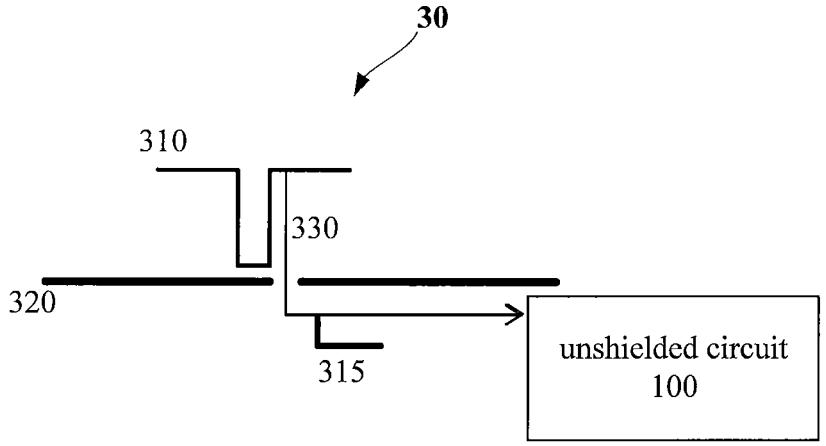
FIG. 3 is a schematic diagram of a portion of an antenna system according to an embodiment of the present disclosure.

FIG. 3 is a schematic diagram of a portion of an antenna system according to an embodiment of the present disclosure. As shown in FIG. 3, the antenna system includes a radiating unit assembly 30 that includes a radiating element 310 and an unshielded circuit 100. The radiating element 310 may comprise, for example, a dipole, a cross-dipole, a patch radiating element or any other appropriate radiating element for transmitting and receiving RF and/or microwave signals. The antenna system may comprise, for example, a phased array antenna that includes a plurality of radiating elements 310. In an example embodiment, the antenna system may comprise a base station antenna having at least one vertical array of radiating elements. The radiating element 310 may be connected to the unshielded circuit 100 through, for example, a phase cable 330.

In a typical phased array antenna, each radiating element 310 is connected to a reflector 320. The reflector may serve as a ground plane for the antenna and may be electrically grounded. However, when service and/or maintenance work are performed on the antenna, for example, technical personnel may separate the radiating element 310 from the reflector 320, and thus the radiating element 310 may no longer be connected to ground. Because of this, an unexpected current may leak through the outer conductor of the phase cable 330.

In order to reduce or eliminate this unexpected current, an open connect line 315 may be connected adjacent to a connection point between the radiating element 310 and the phase cable 330, as is illustrated in FIG. 3. According to an embodiment of the present disclosure, the open connect line 315 is connected adjacent the connection point between the radiating element 310 and the phase cable 330 via welding. It will be appreciated, however, that other connection points and other ways of connecting the open connect line 315 to the cable 330 may be employed in other embodiments. In one embodiment of the disclosure, the open connect line 315 is L-shaped. However, the present disclosure is not limited thereto and the open connect line 315 can be formed in any desired shape such as a straight line shape, etc.

Figure 4:
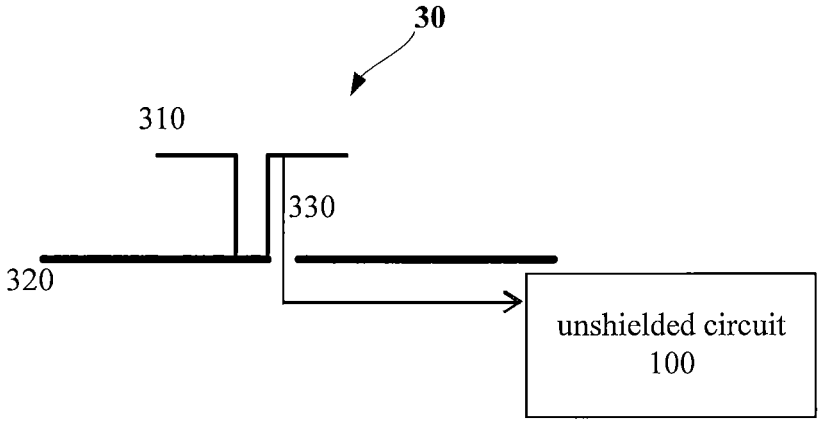
FIG. 4 is an equivalent schematic diagram of the antenna system of FIG. 3.
Figure 5:
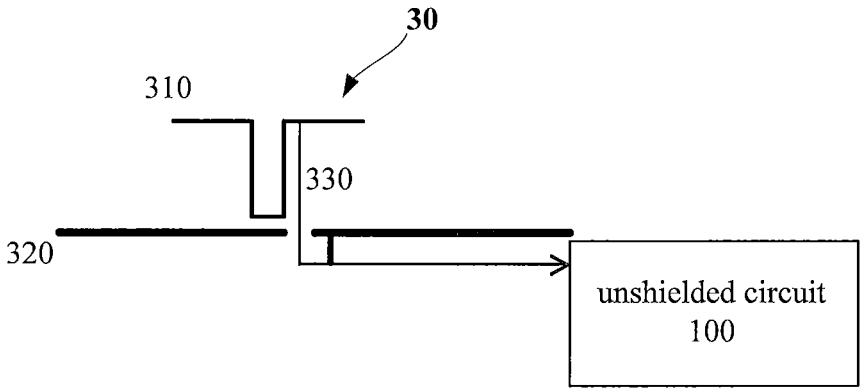
FIG. 5 is another equivalent schematic diagram of the antenna system of FIG. 3.

According to an embodiment of the present disclosure, a length of the open connect line 315 may be about ¼ of a wavelength corresponding to a center frequency of a frequency band in which the radiating element 310 is configured to transmit and receive signals. At microwave and radio frequencies, using an open connect line 315 with a length of ¼ of a wavelength may be equivalent to connecting the phase cable 330 to an electrically grounded element such as, for example, the reflector 320 of the antenna. FIGS. 4 and 5 are two equivalent schematic diagrams of the portion of the antenna system shown in FIG. 3 according to an embodiment of the present disclosure.

As shown in FIG. 4, connecting the open connect line 315 of FIG. 3 to the phase cable 330 is equivalent to connecting the radiating element 310 to the reflector 320. As such, the unexpected current from the phase cable 330 may be shorted to ground. Alternatively, as shown in FIG. 5, connecting the open connect line 315 of FIG. 3 to the phase cable 330 is equivalent to connecting the phase cable 330 to a grounded element such as the reflector 320, and thus once again the unexpected current from the phase cable 330 may be shorted to ground and thus reduced or eliminated. Accordingly, by providing the open connect line 315, the radiating element 310 may be effectively grounded such that unexpected currents from the phase cable may be reduced or eliminated.

Therefore, in this embodiment, although the radiating element 310 does not actually touch the reflector 320 nor is it otherwise electrically connected to the reflector 320 to provide grounding, the current from the outer conductor of the phase cable 330 may still be reduced or eliminated, and thus a common mode resonance may also be reduced or eliminated. Additionally, the PIM level and the isolation stability of the antenna may be improved.

Figure 6:
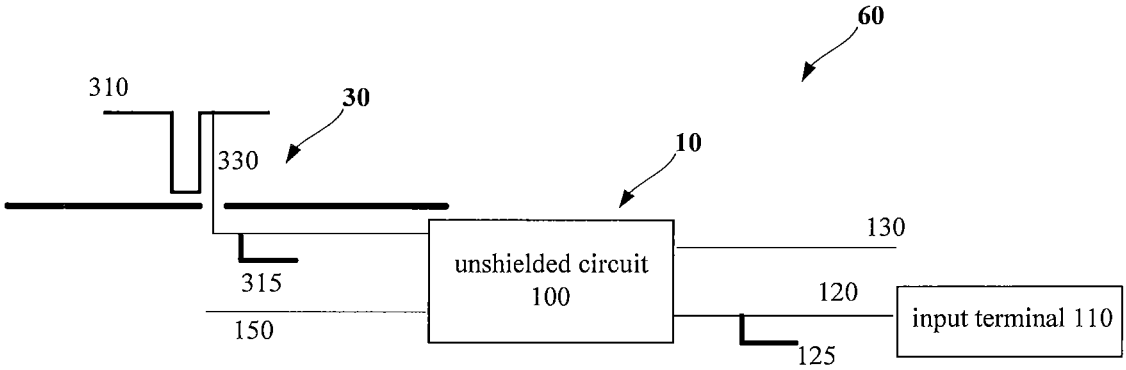
FIG. 6 is a schematic diagram of an antenna assembly according to another embodiment of the present disclosure.

FIG. 6 is a schematic diagram of an antenna assembly 60 according to an embodiment of the present disclosure. The embodiment of FIG. 6 is a combination of the embodiments of FIGS. 1 and 3. The antenna assembly 60 comprises a plurality radiating elements 310 although only one radiating element 310 is shown in FIG. 6 for illustration. The antenna assembly 60 includes an unshielded circuit 100 and an input terminal 110. The input terminal 110 of the antenna may be configured to receive input data from, for example, a radio, and may be connected to the unshielded circuit 100 via an input cable 120.

As shown in FIG. 6, the radiating elements 310 may be mounted to extend above the reflector 320 of the antenna assembly 60, while an antenna feed network that includes the unshielded circuit 100 is mounted below the reflector 320.

One terminal of each of a plurality of phase cables 330, 130 and 150 (shown as three phase cables in FIG. 6) are connected to the input cable 120 via the unshielded circuit 100. The other terminal of each phase cable 330, 130 and 150 is connected to a respective one of the radiating elements. FIG. 6 only shows the connection between the phase cable 330 and the radiating element 310 for illustration, and the other two phase cables 130 and 150 may be connected to corresponding radiating elements in the same manner.

In order to eliminate the unexpected current in the unshielded circuit 10, an open connect line 125 can be connected to a cable that is connected to the unshielded circuit 100. In some embodiments, testing may be performed to identify the cables on which unexpected currents are detected and open connect lines 125 may then be attached to the identified cables. Thus, for example, if an unexpected current is detected on the input cable 120, then an open connect line 125 may be connected to the input cable 120 to eliminate this unexpected current, as shown in FIG. 6. In one embodiment of the present disclosure, the input cable 120 is connected to the open connect line 125 adjacent the unshielded circuit 100.

Further, in order to eliminate an unexpected current in the radiating unit assembly 30, an open connect line 315 is connected adjacent a connection point between the radiating element 310 and the phase cable 330 to eliminate the unexpected current. Open connect lines 315 (not shown) may similarly be connected to the phase cables 130, 150 at the connections between the phase cables 130, 150 and their corresponding radiating elements 310.

According to an embodiment of the present disclosure, the length of the open connect line 125 and/or the length of the open connect line 315 may be about a ¼ wavelength of a center frequency of a frequency band of the antenna assembly/antenna. In one embodiment, the open connect lines 125/315 may be formed as L-shaped lines, as shown in FIG. 6. However, the present disclosure is not limited thereto and the open connect line 125 and/or 315 can be formed in any desired shape such as a straight line shape, etc. The connection between the open connect lines 125 and/or 315 and the corresponding cables can be accomplished by wielding.

According to embodiments of the present disclosure, the open connect line 125/315 may be a rod made of metal or a rod with metal coating, such as a RF coaxial cable or a copper rod, etc. Under the common operating frequency of 600-2700 MHz, a general RF coaxial cable may be used as the open connect line.

The above depiction is provided to enable those skilled in the art to implement or use the present disclosure. For those skilled in the art, various modifications of the present disclosure are apparent, and the general principle defined herein may also be applied to other transformations without departing from the spirit and scope of the present disclosure.

Thus, the present disclosure is not limited to the examples and designs as described herein, but should be consistent with the broadest scope of the principle and novel characteristics thereof.

What is claimed is:

1. An antenna assembly comprising:

a plurality of radiating elements;

an unshielded circuit; and an input terminal, wherein the plurality of radiating elements are connected to the unshielded circuit through respective ones of a plurality of additional cables, and the unshielded circuit is connected to the input terminal through an input cable, wherein at least one of the plurality of additional cables or the input cable comprises an outer conductor that is configured to carry current to the unshielded circuit and is connected to a first open connect line, and wherein the first open connect line is welded or integral to the at least one of the plurality of additional cables or the input cable.

2. The antenna assembly according to claim 1, further comprising a second open connect line that is connected adjacent a connection point between a first of the radiating elements and a first of the additional cables that is connected to the first of the radiating elements.

3. The antenna assembly according to claim 2, wherein the second open connect line is connected adjacent the connection point between the first of the radiating elements and the first of the additional cables via welding.

4. The antenna assembly according to claim 1, wherein at least one of a length of the first open connect line or a length of the second open connect line is ¼ a wavelength corresponding to a center frequency of an operating frequency band of the antenna assembly.

5. The antenna assembly according to claim 1, wherein at least one of the first open connect line and/or or the second open connect line is L-shaped.

6. The antenna assembly according to claim 1, wherein the input cable is connected to the first open connect line.

7. The antenna assembly according to claim 1, wherein the at least one of the plurality of additional cables and the input cable is connected to the first open connect line adjacent the unshielded circuit.

8. The antenna assembly according to claim 1, wherein the unshielded circuit comprises a power divider or a phase shifter.

9. The antenna assembly according to claim 1, wherein a radiating element of the plurality of radiating elements comprises a dipole.

10. The antenna assembly according to claim 1, wherein the plurality of radiating elements define a phased array of a base station antenna, and wherein the first open connect line is electrically equivalent to a grounded element at radio and/or microwave operating frequencies of the plurality of radiating elements.

11. The antenna assembly of claim 1, wherein the first open connect line is integral to the at least one of the plurality of additional cables or the input cable and comprises a metal rod.

12. The antenna assembly of claim 1, wherein the first open connect line comprises a radio frequency (RF) coaxial cable.

13. An unshielded circuit assembly for use in an antenna, comprising:

an unshielded circuit;

an input cable; and a plurality of additional cables, wherein the input cable and the plurality of additional cables are connected to the unshielded circuit, wherein at least one of the input cable or the plurality of additional cables comprises an outer conductor that is configured to carry current to the unshielded circuit and is connected to an open connect line, and wherein the open connect line is welded or integral to the at least one of the input cable or the plurality of additional cables.

14. The unshielded circuit assembly according to claim 13, wherein a length of the open connect line is ¼ of a wavelength corresponding to a center frequency of an operating frequency band of the antenna.

15. The unshielded circuit assembly according to claim 13, wherein the open connect line is L-shaped.

16. The unshielded circuit assembly according to claim 13, wherein the input cable is connected to the open connect line.

17. The unshielded circuit assembly according to claim 13, wherein the at least one of the input cable and the plurality of additional cables is connected to the open connect line adjacent the unshielded circuit.

18. The unshielded circuit assembly according to claim 13, wherein the unshielded circuit comprises a power divider or a phase shifter.

19. A radiating unit assembly used with an antenna comprising:

a radiating element; and an unshielded circuit, wherein the radiating element is connected to the unshielded circuit through a cable comprising an outer conductor that is configured to carry current to the unshielded circuit, wherein an open connect line is connected adjacent a connection point between the radiating element and the cable, and wherein the open connect line is welded or integral to the cable.

20. The radiating unit assembly according to claim 19, wherein a length of the open connect line is ¼ of a wavelength corresponding to a center frequency of an operating frequency band of the antenna.

21. The radiating unit assembly according to claim 19, wherein the open connect line is L-shaped.

22. The radiating unit assembly according to claim 19, wherein the open connect line is connected adjacent the connection point between the radiating element and the cable.

23. The radiating unit assembly according to claim 19, wherein the radiating element comprises a dipole.

* * * * *